US005124015A

United States Patent [19]

Crahay et al.

[11] Patent Number: 5,124,015

[45] Date of Patent: Jun. 23, 1992

[54] MEANS FOR FORMING A CONTINUOUS ELECTROLYTIC DEPOSIT OF CONSTANT THICKNESS

[75] Inventors: Jean Crahay, Francorchamps; Roger Franssen, Montzen; Marios Economopoulos, Liège, all of Belgium

[73] Assignee: Centre de Recherches Metallurgiques - Centrum Voor Research in de Metallurgie, Brussels, Belgium

[21] Appl. No.: 618,568

[22] Filed: Nov. 27, 1990

[30] Foreign Application Priority Data

Nov. 27, 1989 [BE] Belgium ..... 08901269

[51] Int. Cl.[5] ..... C25D 17/00

[52] U.S. Cl. ..... 204/206

[58] Field of Search ..... 204/206

[56] References Cited

U.S. PATENT DOCUMENTS 4,806,223 2/1989 Murakami ..... 204/206

*Primary Examiner*—T. M. Tufariello

*Attorney, Agent, or Firm*—Fleit, Jacobson, Cohn, Price, Holman & Stern

[57] ABSTRACT

A continuous electrolytic deposit of constant thickness is formed on a moving substrate (2) constituting a cathode passing in adjacent spaced relation to an anode (3) to provide a narrow electrolysis gap therebetween. The anode consists of a plurality of anode modules (3) which are supported mechanically independent of each other. The electrical and hydraulic circuits respectively feeding the anode modules include flexible sealing members (8, 11, 12, 14) between the fixed sources of current and electrolyte respectively and the anode modules. The anode modules are provided with supports (4, 9, 10) whereby they are supported on the cathode (2) or on a surface (1) directly linked to the cathode. The support for at least one anode module (3) may be adjustable for adjusting the distance between the anode module and the cathode. The supports (4) are shoes or rollers, for example, which may be mounted at the ends of arms (9, 10) supporting the anode modules.

15 Claims, 6 Drawing Sheets

MEANS FOR FORMING A CONTINUOUS ELECTROLYTIC DEPOSIT OF CONSTANT THICKNESS

FIELD OF THE INVENTION

This invention relates to apparatus for forming a continuous electrolytic deposit of constant thickness on a moving substrate such as a moving metal strip and more particularly to the provision of a small uniform distance between the anode and the cathode so that high current densities can be used while restricting ohmic losses in the electrolyte.

The apparatus according to the invention applies both to the deposition of a permanent protective coating on a metal strip and the manufacture of a thin foil which is subsequently separated from the substrate on which it is formed. In the description which follows reference will be made for simplicity to an electrolytic deposit or coating.

It is known that the use of a narrow electrolysis gap, i.e. a short distance between the anode and cathode, makes it possible to achieve high rates of circulation of the electrolyte in this gap without needing excessively large overall flows. Under these circumstances high current densities which result in high yields of electrolytic deposit can be used.

Furthermore it is also known that a narrow electrolysis gap can reduce the electric losses caused by the resistance of the electrolyte.

Anodes which ensure that the electrolyte has a short path in a narrow electrolysis gap, with high turbulence and a low flow, which thus makes it possible to use high current densities, are known, in particular from Belgian patents BE-A-905588 and BE-A-08700561.

With known anodes there is, however, a problem concerning the uniformity of the electrolysis gap. In fact the cathode consisting of the substrate passes in front of these anodes with a gap which can vary in relation to mechanical or thermal deformations in the substrate itself or its supporting and guide rollers. Furthermore, the geometrical shape of the substrate and/or its supporting and guide rollers can also have imperfections which have an unfavorable effect on the uniformity of the electrolysis gap. It is, however, essential that this electrolysis gap should be as uniform as possible, i.e. variations in it should be held within limits which are as narrow as possible. In fact the relative importance of these variations becomes greater the narrower the electrolysis gap, and corresponding changes occur in the resistance of the electrical circuit, the current density and finally the efficiency of the electrolytic deposition process.

BRIEF SUMMARY OF THE INVENTION

The object of this invention is to provide means for overcoming this disadvantage by using simple means to ensure that the electrolysis gap remains uniform, even if the substrate and/or supporting and guide rollers should be deformed.

In accordance with this invention an apparatus is provided for forming a continuous electrolytic deposit of constant thickness on a moving substrate in which a cathode consisting of the moving substrate moves in front of an anode with which it bounds a narrow electrolysis gap, the anode having orifices which open into the electrolysis gap. The anode consists of a plurality of mutually mechanically independent anode modules in which the electric and hydraulic circuits feeding the anode modules include flexible members between the fixed sources of current and electrolyte respectively and the anode modules, and the anode modules are provided with means whereby they are supported on the cathode or on a surface which is directly linked to the cathode.

It has also proved useful, within the scope of the invention, that the means of support for at least one anode module include means for adjusting the distance between the anode module and the cathode or the surface directly linked to the cathode.

For the purposes of this application a surface directly linked to the cathode is a supporting surface which lies at a known, preferably constant distance from the cathode. It consists for example of the surface of the drum of a radial electrolysis cell against which the substrate is applied as it passes through the electrolytic solution. In this case the distance between the cathode and the surface directly linked to the cathode is equal to the thickness of the product being coated at any point in the electrolysis gap. In a straight cell where the cathode substrate passes before the anode in a straight line this surface directly linked to the cathode may consist in particular of the cathode support rollers along its straight path.

The supporting members comprise for example shoes having a low coefficient of friction, or rollers, which slide or roll, respectively, on the cathode or on the surface directly linked to the cathode.

In accordance with a particular embodiment of the apparatus according to the invention the adjustable supporting means are at least in part located within the electrolysis cell. In this case at least the part is constructed of a material which is resistant to the electrolyte. By way of example these parts are constructed of PTFE (polytetrafluoroethylene), while the rollers may consist of a ceramic material or stainless steel.

Furthermore, the material which is resistant to the electrolyte is preferably electrically insulating, or the members which it forms are electrically insulated from the anode and/or cathode so as to avoid anodic corrosion of these members or on the contrary cathodic deposition on these same members.

In accordance with another embodiment of the invention, the adjustable means of support are located outside the electrolysis cell.

This arrangement allows greater freedom in the choice of the materials which can be used and offers greater facilities for adjustment; it does, however, require that an adequate seal be provided between the interior and the exterior of the cell, in particular along the mechanical members which connect the anode modules to their supports between the active portion and the cathode supporting portion, and if necessary along the inputs of electric current to the anode modules.

In accordance with a particular embodiment of the apparatus with adjustable means of support located outside the electrolysis cell, the means of support include hollow arms which provide both mechanical support and a hydraulic feed to the anode modules at the same time. In this arrangement the anode modules are preferably provided with an individual hydraulic feed, for example from a main of large cross-section located outside the electrolysis cell.

BRIEF DESCRIPTION OF THE DRAWINGS

Other features and advantages of the invention will be seen from the detailed description which follows. This description relates to a number of particular embodiments of this invention which are illustrated in the accompanying drawings wherein.

These figures are diagrammatical representations, to no particular scale, in which only the members necessary for an understanding of the invention have been illustrated. The directions of flow of both electricity and fluids are indicated by appropriate arrows. Identical or similar members, or members which perform identical or similar functions, are indicated by the same numerical references in all the figures.

DETAILED DESCRIPTION OF PREFERRED EMBODIMENTS

Figure 1:
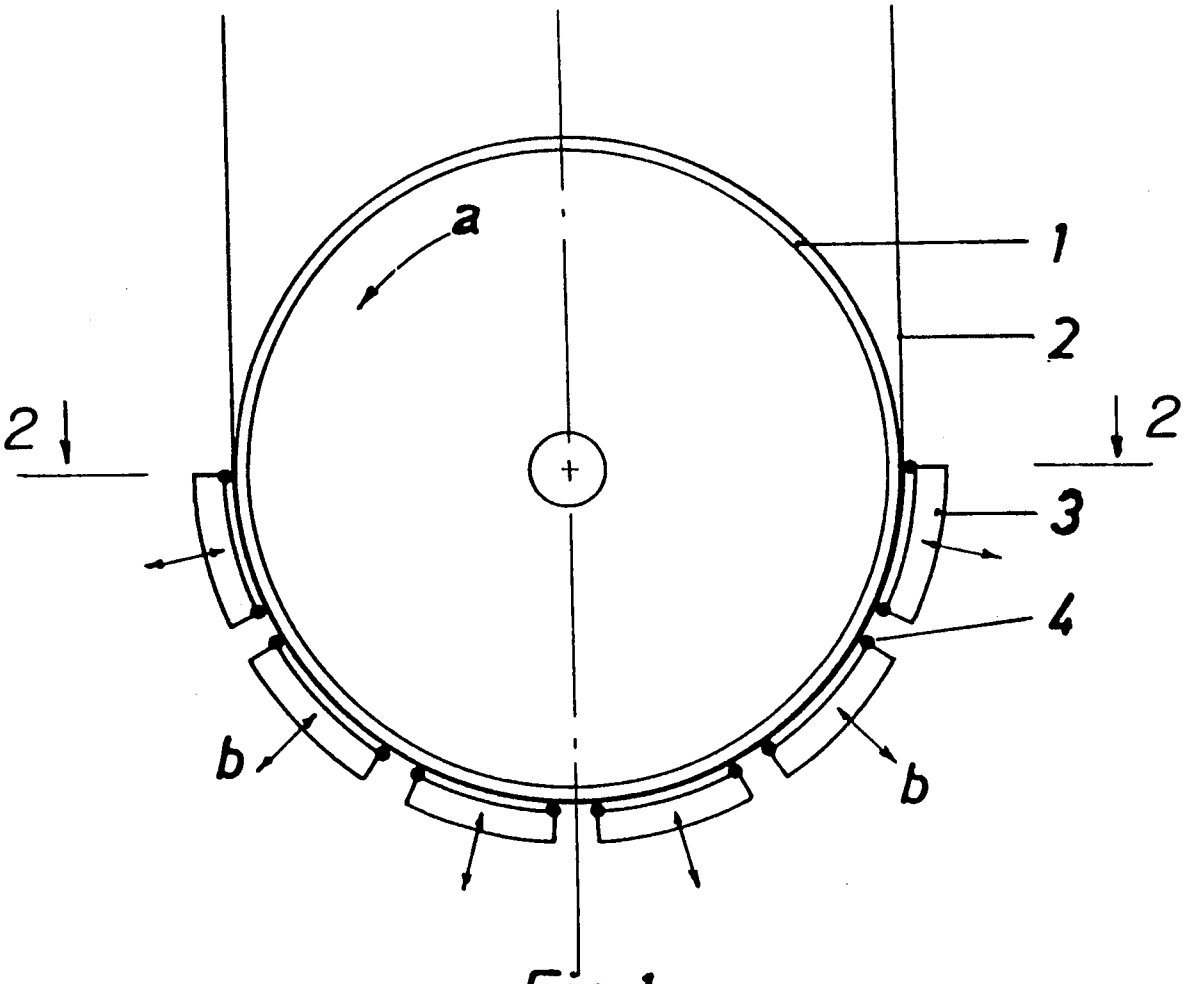
FIG. 1 is a schematic view which illustrates the principle of the apparatus according to the invention applied to a radial electrolysis cell.

FIG. 1 illustrates the principle of the means according to the invention in the case of a radial electrolysis cell of the conventional type.

In a manner which is in itself known the electrolysis cell includes a cathode, comprising a substrate 2 passing round a drum or roller 1, and an anode placed opposite at least part of the perimeter of roller 1 at a predetermine distance therefrom.

In accordance with the invention the anode consists of a plurality of anode modules 3, which are mechanically independent of each other and are each provided with support means 4 relative to cathode roller 1 or substrate 2. Arrow a indicates the direction of rotation of roller 1. Arrows b indicate the direction of movement permitted by the mechanical independence of anode modules 3. Finally it will be remembered that in a cell of this type cathode roller 1 and the anode, namely anode modules 3 in this case, are generally immersed in the electrolyte bath. Within the scope of this invention anode modules 3 may consist of special anodes of the type described in the aforesaid Belgian patents BE-A-905588 and BE-A-08700561.

Figure 2:
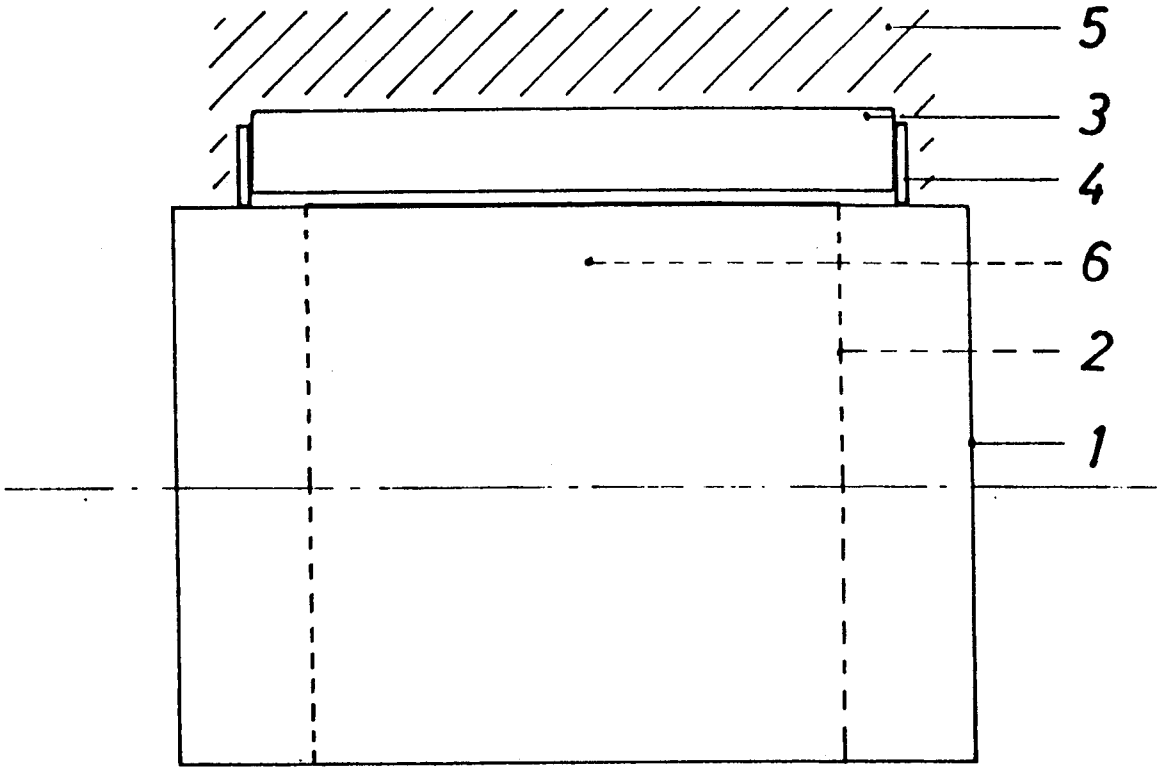
FIG. 2 is a schematic view taken from line 2—2 in FIG. 1 which illustrates an example of the mounting of an anode module provided with means of support located within the cell.

FIG. 2 illustrates an example of the mounting of an anode module 3 provided with support means located inside the electrolysis cell seen from direction 2—2 in FIG 1. In this arrangement the anode modules 3 and their support means 4 are immersed in the electrolyte, indicated symbolically by hatched area 5. In order to withstand the electrolyte the metal parts of the cathode and anode modules are preferably constructed from titanium or an alloy such as hastelloy or from stainless steel. The support means comprise for example shoes 4 of PTFE which have a low coefficient of friction while at the same time being unaffected by the electrolyte.

As can be seen in FIG. 2, shoes 4 are in this case located on either side of deposition zone 6 corresponding to substrate 2. Shoes 4 may be provided with means of adjustment which are in themselves known and not shown here, in order to vary the distance between substrate 2 and anode module 3 and/or to correct changes in this distance due for example to wear of shoes 4. By way of example these means of adjustment may consist of vertical threaded rods provided with nuts adjusting the position of the anode module.

Figure 3:
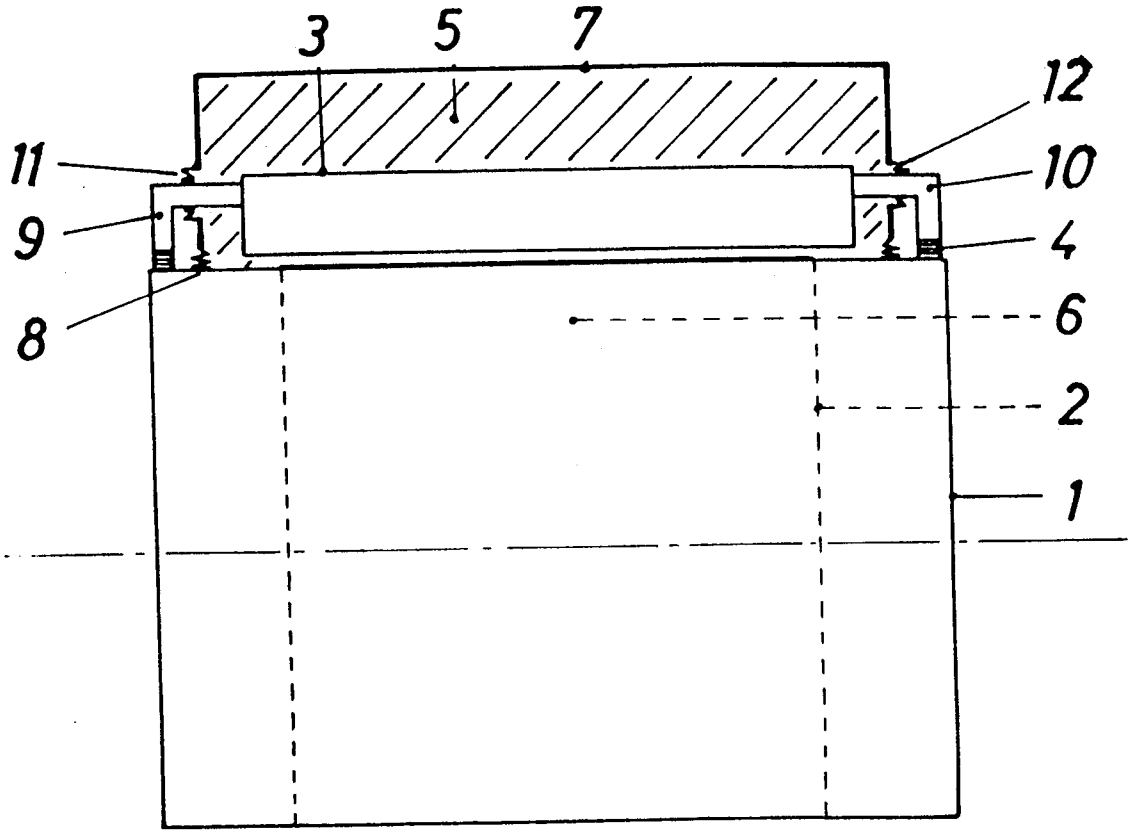
FIG. 3 is a view similar to FIG. 2 which illustrates an example of the mounting of an anode module provided with means of support located outside the cell.
Figure 4:
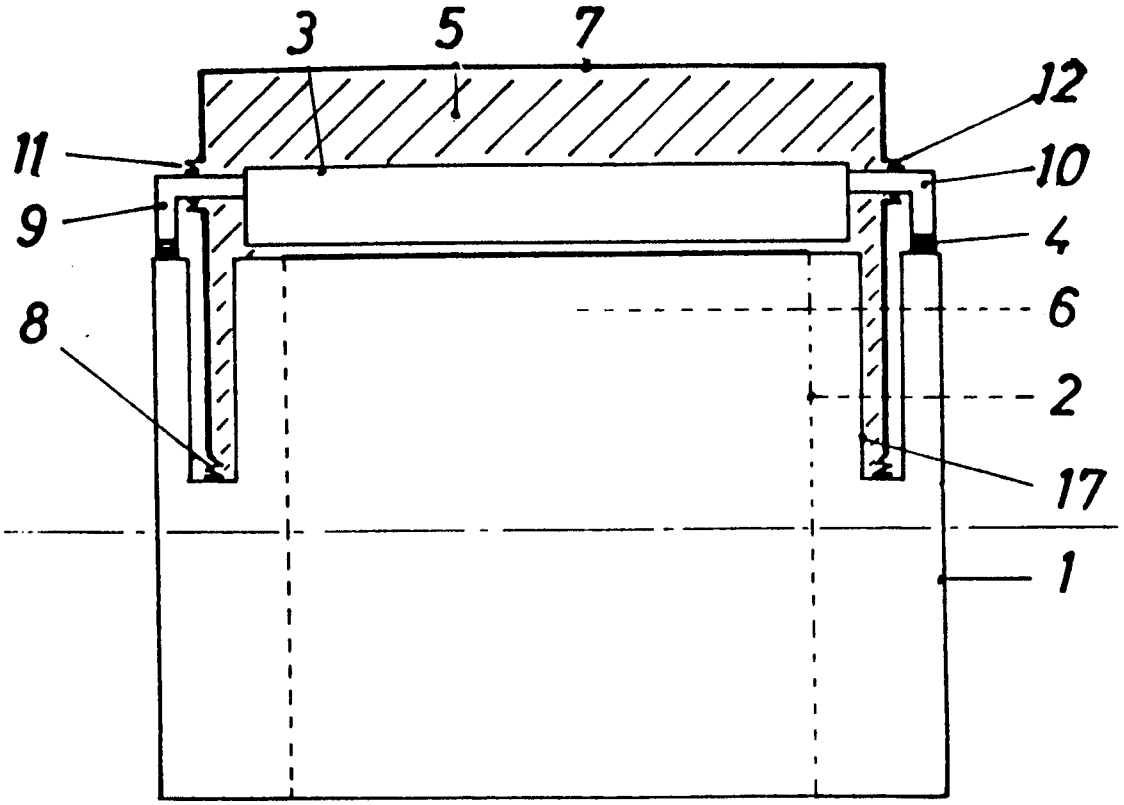
FIG. 4 is a view similar to FIG. 2 which illustrates another example of the mounting of an anode module provided with means of support located outside the cell.
Figure 5:
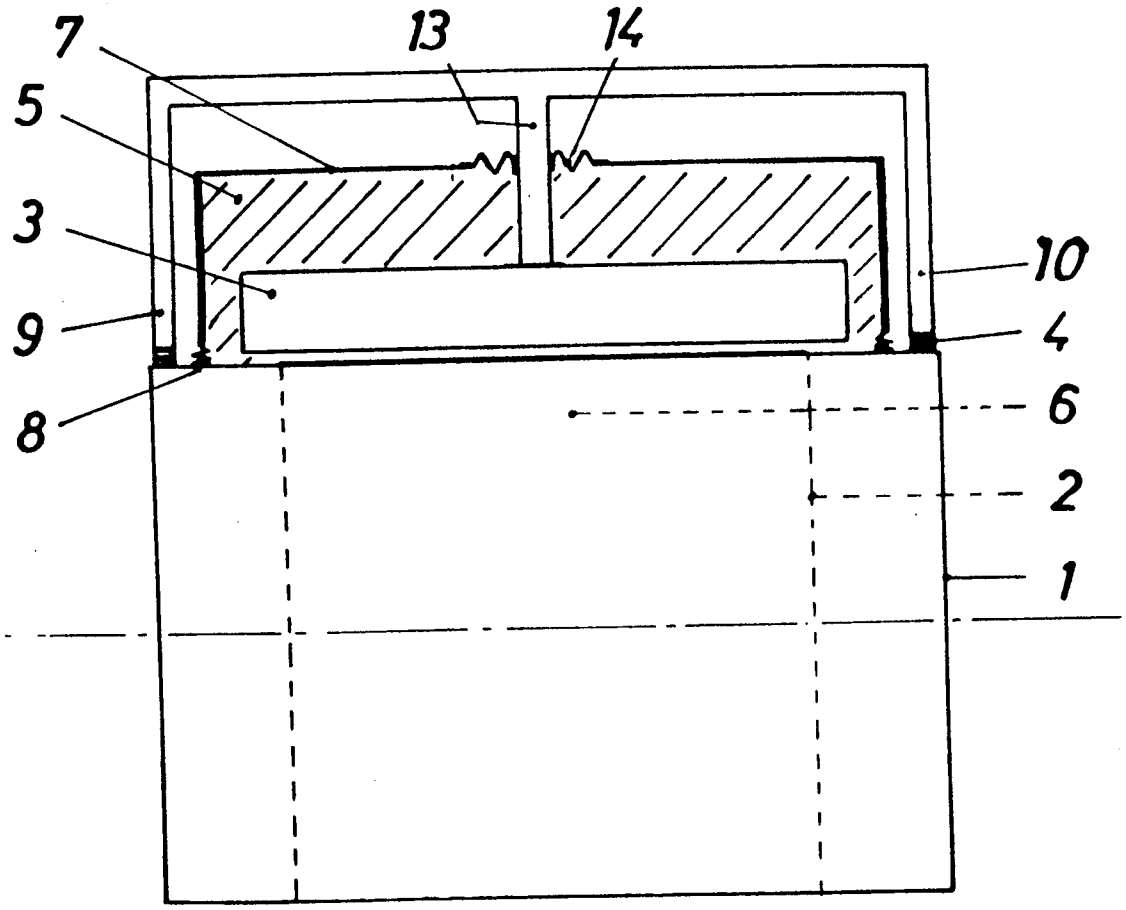
FIG. 5 is a view similar to FIG. 2 which illustrates a further example of the mounting of an anode module provided with means of support located outside the cell.

FIGS. 3–5 illustrate various examples of the mounting of an anode module 3 whose support means 4 are located outside the electrolysis cell. In this arrangement anode module 3 is surrounded by an enclosure 7 which contains electrolyte 5. This enclosure 7 extends axially over a width equal to at least the width of deposition zone 6 or substrate 2, and peripherally over at least part of the perimeter of roller 1, to which it is attached through rotating seals 8. These seals 8 thus ensure a seal between the active part and the supporting parts of cathode roller 1. Substrate 2 and deposition zone 6 are similar to those in FIG. 1. Here again the assembly of anode module 3 is seen in the direction A in FIG. 1. Circulation of the electrolyte is effected by means which are known in themselves, in particular from the two aforesaid Belgian patents, which do not form part of this invention and which are not therefore illustrated.

In FIG. 3 anode module 3 is provided with two elbowed arms 9,10 which pass through the side walls of enclosure 7 respectively and rest with their outer extremities on the surface of roller 1. These arms 9,10 are provided at their outer extremities with means of support consisting of rollers 4, for example, which roll on roller 1. The rollers 4 are preferably constructed of a material which is resistant to wear, such as a ceramic material or a synthetic material such as PTFE, polyethylene (PE) or polypropylene (PP). The locations 11,12 where arms 9,10 pass through the walls of enclosure 7 are sealed by any known means, for example by means of flexible membranes or bellows of a material which is resistant to the electrolyte, such as rubber, PTFE, PE or PP.

The arrangement in FIG. 4 is substantially identical to FIG. 3. The essential difference is that rotating seals 8 are placed in the base of grooves 17 made in roller 1. This reduces the peripheral length of seals 8, which reduces the risk of electrolyte leakage. Furthermore, the support areas of roller 1 are thus sharply separated from the active area exposed to electrolyte 5.

Another possible arrangement is illustrated in FIG. 5. Here the two arms 9 and 10 are joined to form a stirrup which straddles enclosure 7 and rests on roller 1 by supporting means such as rollers 4. This stirrup 9,10 has a central branch 13 which enters enclosure 7, via a crossing point 14 pierced through the rear wall of enclosure 7, and which bears anode module 3. Crossing point 14 is also sealed by known means such as a flexible membrane or bellows of a material which is resistant to electrolyte 5.

In the situations illustrated by FIGS. 3 to 5 in particular, where the means supporting the anode modules are located outside the electrolysis cell, i.e. outside enclosure 7, electrolyte is delivered to and returns from enclosure 7 and anode modules 3 by means of a conventional hydraulic circuit. It has, however, proved useful to feed each anode module with electrolyte individually in order to ensure greater flexibility in the operation and control of the electrolytic deposition process.

Figure 6:
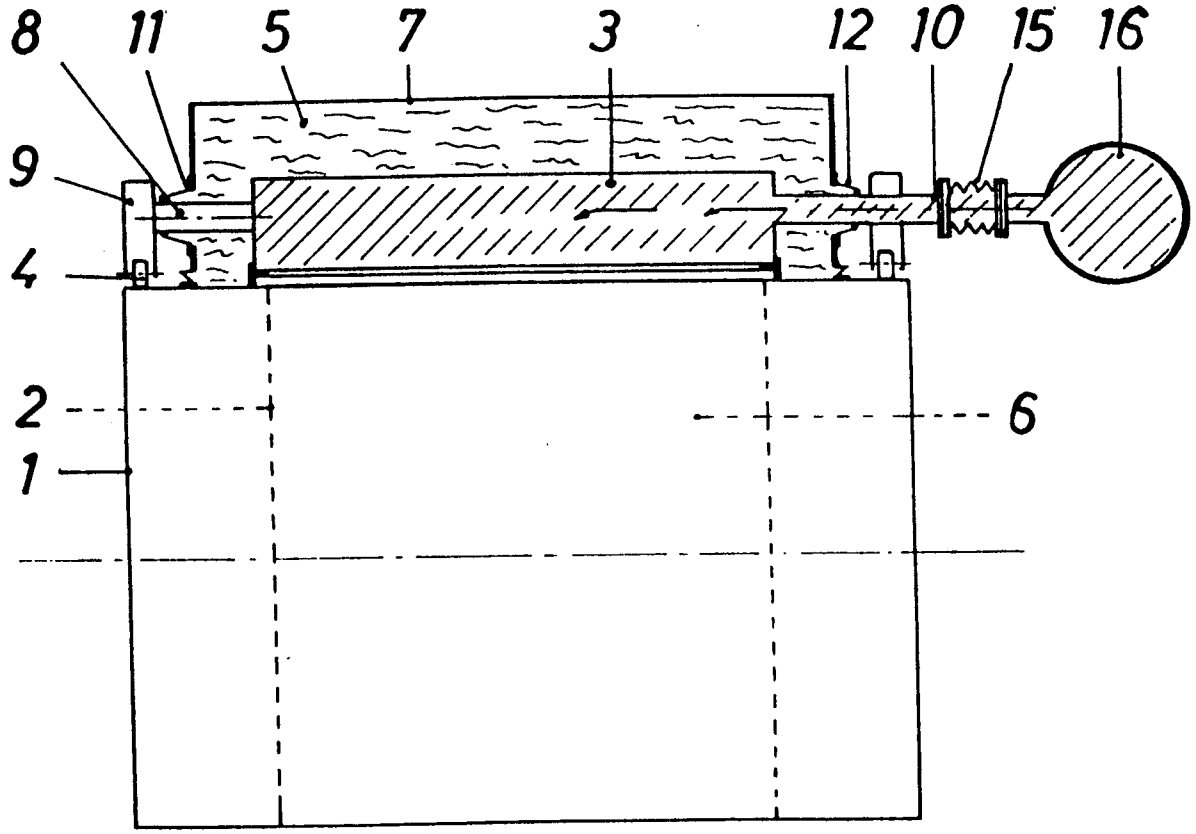
FIG. 6 is a view similar to FIG. 2 which illustrates an embodiment in which the arms of the exterior means of support form members of the hydraulic circuit.

FIG. 6 illustrates a special embodiment whereby each anode module whose means of support are located outside the electrolysis cell can be fed with electrolyte individually.

In this arrangement arm 10 consists of a tube which is connected to a feed main 16 by a flexible member such as a bellows 15. Enclosure 7 acts as the outlet main from which electrolyte 5 is removed by known means, not shown, and may be returned to the feed main after appropriate treatment. The other numerical references correspond to the identical references in FIGS. 3 to 5.

With this arrangement mounting of the anode modules can be simplified, eliminating at least part of the conventional external hydraulic circuits.

It will also not go beyond the scope of this invention if the electrolyte outlet is provided by arm 9 being a tubular arm connected to an outlet main similar to tubular arm 10 and feed main 16.

It must be understood that the invention is not restricted to the particular embodiments which have just been described and illustrated. Numerous modifications may be envisaged, in particular in the shape and arrangement of the means of support for the anode modules and in the arrangement of the anode modules, in particular for their use, following appropriate modification, with a straight electrolysis cell.

We claim:

1. A device for the formation of a continuous electrolytic deposit of constant thickness on a moving substrate, including anode means, cathode forming means for moving a cathode substrate in adjacent spaced relation to said anode means thereby providing a narrow electrolysis gap between said cathode and said anode means, current connection means for connecting said anode means with an electric current source and electrolyte connection means connecting said gap with an electrolyte source, wherein:

said anode means comprise a plurality of mechanically independent anode modules;

support means are provided for said anode modules engaging on a surface of said cathode forming means and operable for maintaining said anode modules at a uniform distance from said substrate;

openings are provided in said anode modules communicating with said electrolysis gap for passing said electrolyte therethrough;

said current source is fixed;

said current connection means comprise flexible connections between said fixed current source and said anode modules;

said electrolyte source is fixed; and said electrolyte connection means comprise flexible connections between said fixed electrolyte source and said openings provided in said anode modules.

2. The device as claimed in claim 1, wherein:

said support means comprise means for adjusting the distance between said anode modules and said cathode.

3. The device as claimed in claim 1, wherein:

said support means comprise a separate support means for each anode module; and at least one of said separate support means is located in the electrolyte in use.

4. The device as claimed in claim 3, wherein:

said separate support means comprises at least one sliding shoe.

5. The device as claimed in claim 1, wherein:

said support means comprise a separate support means for each anode module; and at least one of said separate support means is located outside the electrolyte in use.

6. The device as claimed in claim 5 and further comprising:

an electrolysis cell enclosure having walls surrounding at least one anode module; and wherein said support means comprise arms passing through said walls of said enclosure.

7. The device as claimed in claim 6, wherein:

at least one of said arms comprises an electrolyte-carrying tube communicating with the corresponding anode module.

8. The device as claimed in claim 2, wherein:

said support means comprise a separate support means for each anode module; and at least one of said separate support means is located in the electrolyte in use.

9. The device as claimed in claim 2, wherein:

said support means comprise a separate support means for each anode module; and at least one of said separate support means is located outside the electrolyte in use.

10. The device as claimed in claim 3, wherein:

said support means comprise a separate support means for each anode module; and at least one of said separate support means is located outside the electrolyte in use.

11. The device as claimed in claim 5, wherein:

said separate support means comprises at least one sliding shoe.

12. The device as claimed in claim 10 and further comprising:

an electrolysis cell enclosure having walls surrounding at least one anode module; and wherein said support means comprise arms passing through said walls of said enclosure.

13. The device as claimed in claim 1 and further comprising:

an electrolysis cell enclosure having walls surrounding at least one anode module; and wherein said support means comprises arms passing through said walls of said enclosure.

14. A device for the formation of a continuous electrolytic deposit of constant thickness on a moving substrate, including anode means, cathode forming means for moving a cathode substrate in adjacent spaced relation to said anode means thereby providing a narrow electrolysis gap between said anode means and said cathode substrate, electric current source means connected with said anode means, and electrolyte source means communicating with said gap, wherein:

said anode means comprises a plurality of anode modules;

a plurality of support means is provided for supporting said anode modules relative to said cathode substrate and mechanically independent of each other and movable relative to said current and electrolyte source means;

an electrolysis cell enclosure is provided having walls surrounding at least one anode module; and each support means comprises arms passing through walls of said enclosure and supported relative to said cathode substrate.

15. The device as claimed in claim 14, wherein:

at least one of said arms comprises an electrolyte-carrying tube communicating with the corresponding anode module.

* * * * *